United States Patent [19]

Johnson

[11] 4,303,284

[45] Dec. 1, 1981

[54] INDEX GUIDE MEANS FOR A FILING SYSTEM

[75] Inventor: Sigurd A. Johnson, Glendora, Calif.

[73] Assignee: Plan Hold Corporation, Irvine, Calif.

[21] Appl. No.: 134,350

[22] Filed: Mar. 27, 1980

[51] Int. Cl.[3] ..... A47B 63/00; B42F 21/00

[52] U.S. Cl. ..... 312/189; 312/184; 312/234.4; 40/359; 40/360

[58] Field of Search ..... 312/189, 184, 234.4, 312/234.5, 234.2, 234.3, 183; 40/359, 360

[56] References Cited

U.S. PATENT DOCUMENTS

| | | | |
|---|---|---|---|
| 1,048,577 | 12/1912 | Pardoe, Jr. | 40/359 |
| 1,161,045 | 11/1915 | Griswold | 40/360 |
| 1,390,199 | 9/1921 | Gale | 40/360 |
| 1,927,513 | 9/1933 | Cowden | 40/360 |
| 2,205,903 | 6/1940 | Mobus | 312/189 |
| 2,260,069 | 10/1941 | Whitson | 40/360 |
| 2,307,970 | 1/1943 | Sparks | 40/360 |
| 2,336,572 | 12/1943 | Schuessler | 312/234.4 |
| 2,443,522 | 6/1948 | Smith | 40/360 |
| 2,633,849 | 4/1953 | Daniel et al. | 40/360 |
| 3,849,922 | 11/1974 | Sahlin | 40/360 |

FOREIGN PATENT DOCUMENTS

| | | | |
|---|---|---|---|
| 134522 | 10/1963 | France | 312/184 |
| 205122 | 6/1939 | Switzerland | 312/184 |

*Primary Examiner*—Victor N. Sakran

*Attorney, Agent, or Firm*—Poms, Smith, Lande & Rose

[57] ABSTRACT

A multipositionable index file guide means adapted to be supported from laterally spaced support means for vertical filing of sheet material. In one example, the multipositionable index guide comprises a strip element having a longitudinal axis and longitudinal edge portions, each edge portion having a tab extending laterally with respect to the longitudinal axis and longitudinally offset with respect to the tab on the opposite edge portion. The strip element may be turned about its longitudinal axis for obtaining two tab upward positions in offset relation and may be turned about its lateral axis for obtaining a third upward position of one of said tabs. In another example, the index guide strip element includes a tab extending laterally from each longitudinal edge portion and in longitudinal offset relation, the strip element being adapted to be turned about its longitudinal axis to locate a tab in one of two upward positions. In each example, at least one of the tabs is positioned on the longitudinal edge portion for cooperating with an out-label attached to one surface of the strip element.

3 Claims, 6 Drawing Figures

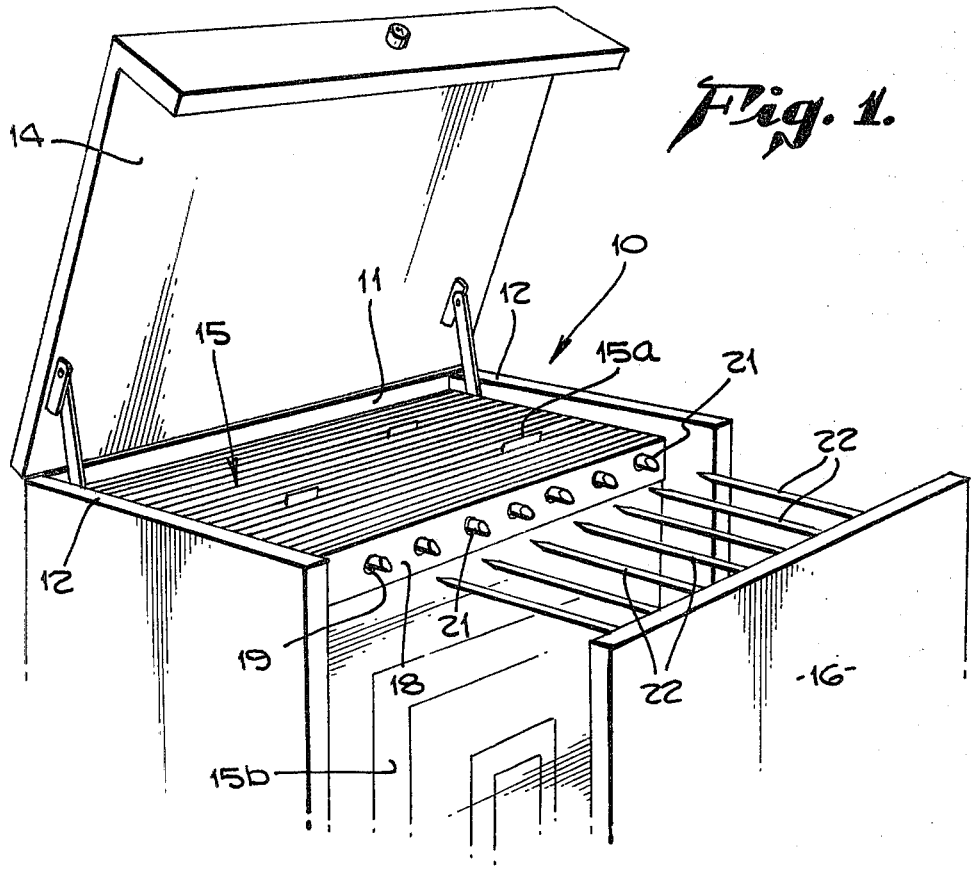
Fig. 1.
Fig. 2.
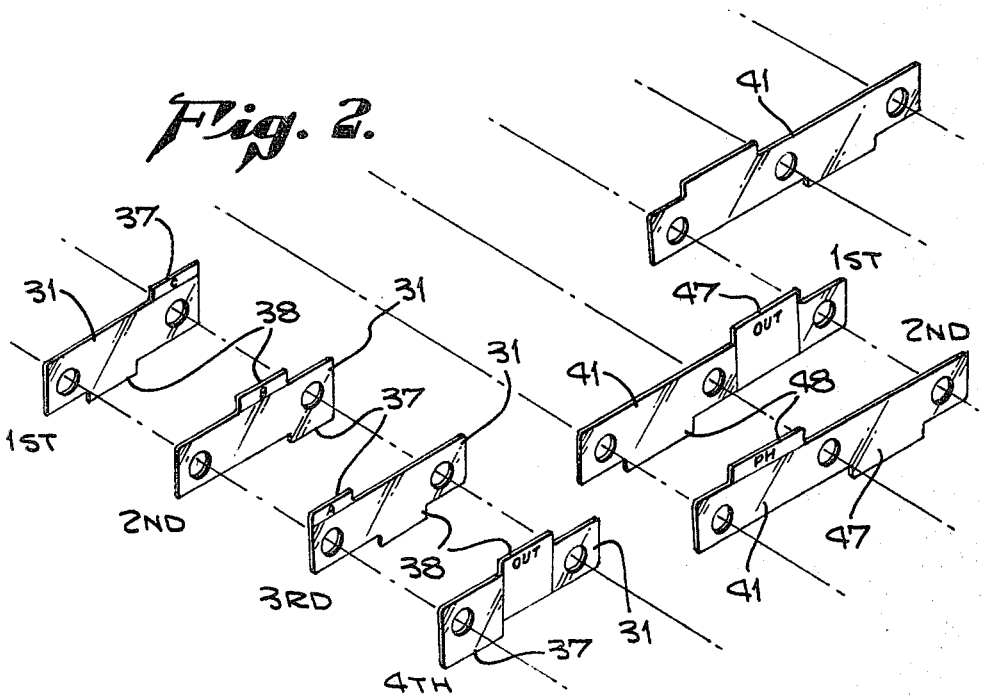

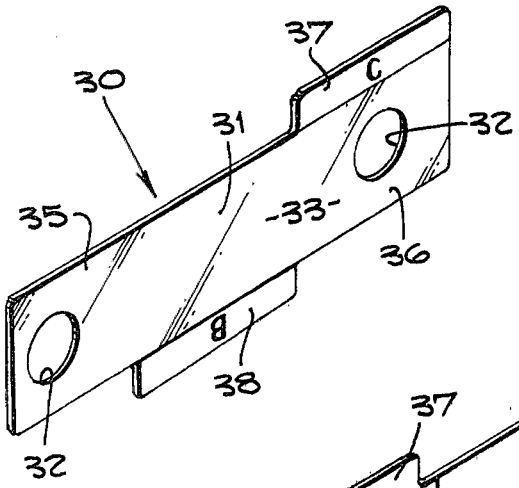
Fig. 3.
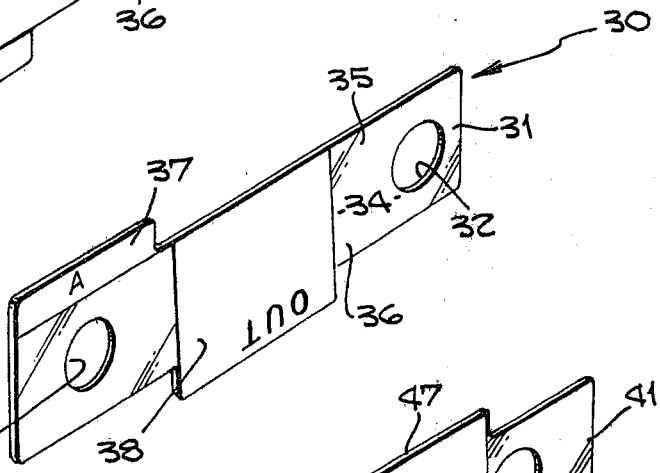
Fig. 4.
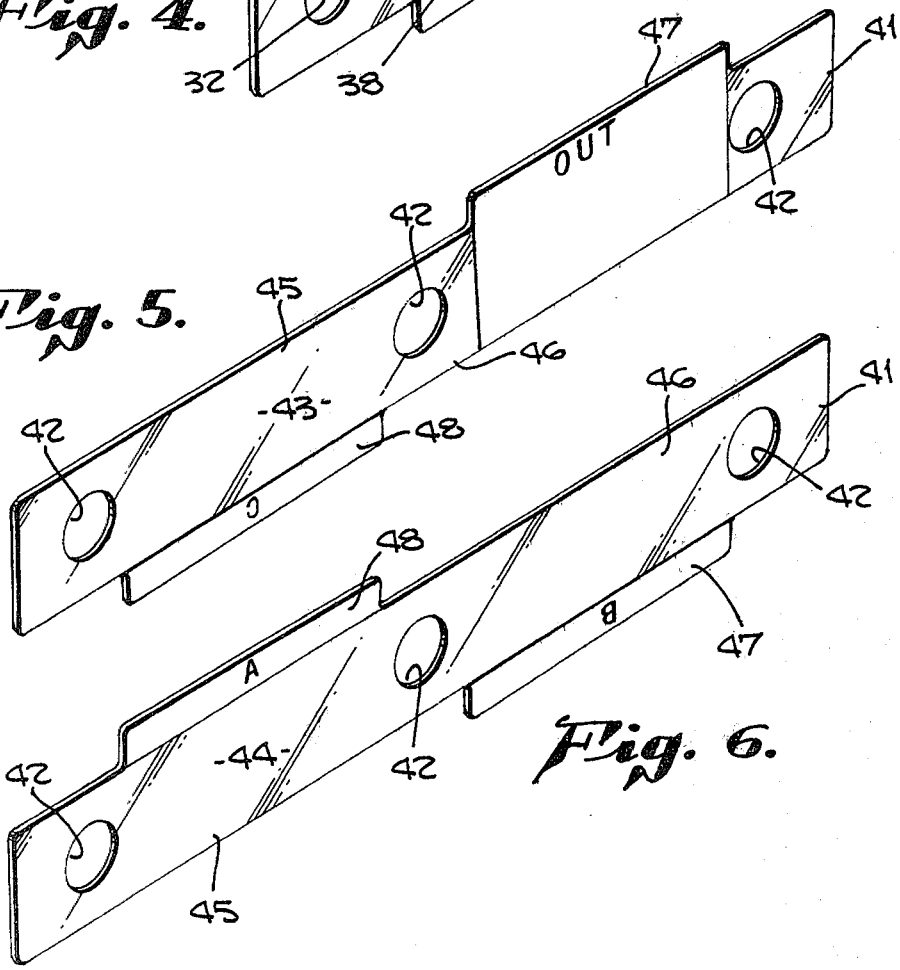
Fig. 5.
Fig. 6.

INDEX GUIDE MEANS FOR A FILING SYSTEM

BACKGROUND OF INVENTION

Vertically disposed file material held in a drawer or a cabinet has been conventionally indexed by inserts provided with upright index tabs readily visible over the upper edge of the file material. Such upright index tabs have conventionally been disposed longitudinally of the file material, cabinet, or drawer and succeeding tabs have been laterally offset across the width of the file material for convenient observation and identification.

In vertical filing of original drawings, charts, maps, graphics, or sets of plans of different width, intermixing of drawing sizes may occur. An exemplary cabinet for such filing may be a Plan Hold Master File in which a cabinet housing is provided with a hinged top wall and a front wall which is slidably or rollably mounted for movement forwardly of the cabinet and its contents for convenient access to vertically filed sheet material within the cabinet housing. The vertically filed material is supported on a plurality of laterally spaced hollow cylindrical rods carried by the back wall of the housing and within which are telescopically received pins carried by the separable front wall.

In such a system, index guides have been used comprising a longitudinally extending strip member provided with holes corresponding to the spacing of the support rods and upright tabs which extend above the top edges of the file materials. Such index tabs were generally longitudinally aligned at the outboard edge portions of the strip. Further, a separate longitudinal strip member containing a chart of identification of drawings withdrawn from the file was provided with openings corresponding to the support members and was placed on the support members when drawings or a group of drawings were withdrawn from the file cabinet to indicate absence of such drawings and the party who had withdrawn the drawings. Such a strip bore and the word "OUT" to indicate which had been removed from the cabinet housing.

Such prior proposed index guide means and OUT strips did not fulfill all of the requirements of flexible, comprehensive, facile indexing of the drawings because the upright tabs were aligned in longitudinally extending rows and the OUT strips were separately located on the support members. An additional step of shifting drawings to reach the OUT strips was often required to properly record information on the OUT label.

SUMMARY OF INVENTION

The present invention relates to an index file guide means which is multipositionable and readily serves at least two purposes; namely, that of conveniently indexing the filing material in various arrangements and of providing ready identification of material withdrawn from the cabinet in an efficient effective manner.

The invention particularly relates to a novel index guide strip which is adapted to be turned about at least one of its axes for utilizing an upright index tab located in a position longitudinally offset along the length of the index strip element relative to an index tab located on an opposite longitudinal edge portion of the strip element.

A general object of the present invention is to provide an index file guide means adapted to be used in several different positions in a filing system having at least two parallel file material support members.

An object of the invention to provide an index file guide means arranged to be used as an index guide and as an out guide.

Another object of the invention is to provide a filing system having multipositionable index file guide means wherein each guide strip element is adapted to be used in the filing system in any one of three different positions.

Still another object of the present invention is to provide a filing system having index file guide means in which the index guide strip element is adapted to be used in at least one of two positions of the index guide element.

A still further object of the invention is to provide an index file guide member having index tabs thereon positionable in at least one of a plurality of positions whereby index tabs may be arranged in a convenient readily observable pattern.

Various other objects and advantages of this invention will be readily apparent from the following description of the drawings in which exemplary embodiments of this invention are shown.

IN THE DRAWINGS

FIG. 1 is a fragmentary perspective view of a master-file cabinet housing in which index file guide means of this invention may be utilized.

FIG. 2 is a schematic perspective view illustrating different positions of two examples of index guide means embodying this invention, the laterally spaced axis lines representing the axes of the telescopic support members of the cabinet housing illustrated in FIG. 1.

FIG. 3 is a perspective elevational view of one index guide means of this invention.

FIG. 4 is a perspective view of the index guide means of FIG. 3 turned about its lateral axis and showing the back side of the index guide means of FIG. 3.

FIG. 5 is a perspective view of an index guide means embodying another example of this invention.

FIG. 6 is a perspective view of the index guide means of FIG. 5 turned about its longitudinal axisand showing the back side of the index guide means of FIG. 5.

DETAILED DESCRIPTION

In FIG. 1 an exemplary vertical filing system is shown in a filing cabinet housing which is well-known as a Plan Hold Master File made by Plan Hold Corporation, the assignee of this invention. The cabinet housing generally indicated at 10 comprises a back wall 11, sidewalls 12, and a hinged top wall 14 adapted to be raised and lowered to cover vertically filed material generally indicated at 15. The cabinet housing includes a front wall 16 slidably and rollably supported at the bottom of the housing (not shown) for readily moving front wall 16 away from and towards the side walls. Vertically filed material 15 comprises a plurality of individual or single sheets of material adhesively carried by thin carrier strips 18 provided with two or more holes 19 adapted to receive a plurality of laterally-spaced support means. Each support means comprises a hollow support member or post 21 horizontally positioned and carried by back wall 11 of the housing. Each support means also includes a horizontal pin or rod 22 carried by front wall 16 and adapted to be telescopically received within an aligned post 21 when the front wall 16 is in normal closed assembled relation with the housing 10. When the front wall 16 is in closed relation with the housing 10 the pins 22 extend fully within the posts 21.

In this exemplary filing system when it is desired to select a drawing from the group of drawings in the cabinet housing, the location of the drawing is first determined by index guides and identification provided on the carrier strip 18. When it is desired to remove drawing 15*a* or to insert a drawing at the location of drawing 15*a* the front wall 16 is rolled away from the cabinet housing until the pins 22 are sufficiently exposed to accommodate the span of drawings 15 between 15*a* and 15*b*. These drawings forwardly of drawing 15*a* are then slid by manual means onto the pins 22. Front wall 16 is then moved further forwardly to provide about a two-inch space between the ends of posts 21 and the ends of pins 22. Drawing 15*a* is thus located at the ends of posts 21 and may be readily removed by moving fowardly to clear the ends of posts 21 and lifting vertically.

To file a drawing the above procedure is essentially reversed in that the location for the drawing 15*a* to be filed is determined, drawings in front thereof are moved forwardly onto the pins 22, the pins 22 are then moved further forwardly to disengage their ends with the ends of posts 21, the drawing 15*a* to be filed is then inserted in its proper place, and the front wall 16 and pins 22 are moved toward the cabinet to cause telescopic engagement of the pins 22 within posts 21 and movement of the drawings carried by pins 22 into their normal position on the posts 21.

The above description of the exemplary vertical filing system as represented by the Plan Hold Master File has been made for the purpose of providing a background for the utilization of the novel concept of this invention involving index file guide means for use in such a system. In FIG. 1 only a few index tabs have been illustrated since the number and location of such index tabs would depend upon the filing system used and the grouping of filing material either alphabetically, by drawing number, by project, or whatever other arrangement of drawings is desired by the user of the filing system. In the vertical filing system shown in FIG. 1 utilizing a plurality of telescopically arranged posts 21 and pins 22 it will be apparent that the arrangement is adapted to file sheet material having a width extending approximately between sidewalls 12 and also file sheet material of less width as long as it adapted to be supported by at least two adjacent support members. In an exemplary cabinet construction the spacing between support members may be about 6½ inches and in the illustration 7 support members are shown. It will be understood that the number of support members may be varied for different cabinet sizes.

An exemplary index file guide means of this invention for use with any two of the support members shown in FIG. 1 is shown in FIGS. 3, 4 and the left portion of FIG. 2. Index file guide means generally indicated at 30 may comprise a multipositionable and multipurpose index guide strip element 31 having a longitudinal axis along which two spaced holes 32 are provided of a size to readily accommodate posts 21. Strip element 31 is provided with opposite planar faces 33 and 34 and opposite longitudinal edge portions 35 and 36. In FIG. 3 guide strip element 31 is provided on its longitudinal edge portion 35 with a laterally extending index tab 37 formed opposite one of the holes 32. On the opposite longitudinal edge portion 36 a tab 38 extends laterally in the opposite direction and is located between the two spaced holes 32. Tabs 37 and 38 provide a support for receiving, for example, a longitudinally folded index identification label (not shown) adapted to be adhesively secured over the length of the tab and upon which may appear a desired identification letter of the alphabet, number, or drawing identification.

As best shown in FIG. 2 index strip element 31 is adapted to be positioned in several positions on the support means comprising posts 21 and pins 22. In a first position of index strip 31, tab 37 with label C may be positioned upright, that is for ready viewing above the upper edges of the vertically filed material. Tab 38 is directed downwardly and would not be observed in this position.

In the second position, the index strip element has been turned about its longitudinal axis so that the tab 38 with label B is now positioned upright and the tab 37 is now directed downwardly.

In the third position the index strip element 31 has been turned about its lateral axis so that the upright tab 37 is positioned at the left of the element and that side of the tab is provided with the label A. In the third position the tab 38 is directed downwardly and is not visible.

In a fourth position of the index strip element 31 the strip element as shown in the third position may be turned abouts its longitudinal axis for permitting the tab 38 to appear upright with face 33 toward the viewer. An OUT label may extend from the portion of the strip element below tab 38 onto the face of tab 38 to provide space for recording drawing number, date in, and date out, and initials of the person taking out the drawing. It will thus be apparent that the arrangement of the tabs 37 and 38 on strip element 31 having two holes provides a number of different positions for mounting the file index guide strip for adaptation of the strip element to a number of different circumstances.

The multipositionable, multipurpose strip element 31 is preferably made of a lightweight relatively thin, for example 0.008 inches, plastic material such as a polyester mylar sheet material. Such a strip element is relatively flexible, dimensionally stable, resilient, and provides smooth surfaces to which readily releasable adhesive labels may be attached. It will be apparent that in the use of a plurality of index strip guides 31 along a pair of support means that the tabs 37 and 38 provide lateral offsets for ready visibility at spaced positions longitudinally of the posts 21 and pins 22.

An index file guide strip means for file material wider than that for which strip elements 31 may be used is illustrated in FIGS. 5 and 6 and the right hand portion of FIG. 2. In FIG. 5 an index guide strip 41 has a longitudinal axis along which three spaced holes 42 are provided for sliding cooperation with the posts 21 and pins 22 in the cabinet housing. Index strip 41 has opposite surfaces 43 and 44 and longitudinal edge portions 45 and 46. In this example of an index guide strip a tab 47 is provided along longitudinal edge portion 45 between adjacent holes 42. A tab 48 extends laterally from longitudinal edge portion 46 and is located between adjacent holes 42 at the opposite half of the strip element 41.

As shown in FIG. 2 strip element 41 may be positioned in at least two different positions, a first exemplary position showing tab 47 upright and at the right of the element 41. In an exemplary second position, the tab 48 is upright and at the left of FIG. 2, this change of position being accomplished by turning the index strip element 41 about its longitudinal axis.

Tabs 47 and 48 may receive folded labels for identifying a drawings with which the index guide is to be associated and on one of the faces of element 41 an OUT label bearing the same information as in the prior embodiment may be attached to the surface and extend onto one face of tab 47 for viewability. It will be apparent that file index guide strip elements 41 may be alternated in position across the supporting posts 21 and pins 22 in order to provide a desired file guide indexing system to better indentify file material. The material of index guide strip element 41 is the same as that for strip element 31.

From the above description it will be readily understood that the file index guide strip of this invention provides a multipurpose, multipositionable strip element adapted for use in several situations as described above. In a vertical filing system as illustrated in FIG. 1, having a plurality of supporting posts and pins laterally spaced approximately 6½ inches, the index guide strip 41 and the index guide strip 31 may be so utilized and arranged by the customer that a plurality of longitudinally and laterally offset tabs may be arranged above the top edges of the file material for convenient visibility and in such a manner that file material of different widths may be readily indexed in the same cabinet construction.

Two examples of the invention have been illustrated. It will be understood that other examples may occur in which the relationship between the holes in the index guide file strips may be varied and the relationship of the tabs to the holes in the guide strip may also be changed. All such changes and modifications coming within the scope of the appended claims are embraced thereby.

I claim:

1. In a filing system provided with a plurality of laterally spaced means for supporting file material, each spaced support means having longitudinally separable support members for insertion and removal of file material, the provision of:

a plurality of multi-positionable one-piece file guide means adapted to be mounted on said support means in selected upward position there along for observeable indexing of material;

one of said file guide means being adapted to be arranged in one or more positions and comprising a flat planar strip element having a pair of holes for receiving a pair of support members, a tab having oppositely directed faces for bearing indexing data extending laterally from one longitudinal edge portion opposite one of said holes, and a second tab having oppositely directed faces for bearing additional indexing data extending laterally from the opposite longitudinal edge portion and from between said pair of holes whereby said strip element may be turned about its longitudinal axis for obtaining two tab upward positions in offset relation and may be turned about its lateral axis for obtaining a third upward position of one of said tabs.

2. In a filing system provided with a plurality of laterally spaced support means for supporting file material, each support means having longitudinally separable support members for insertion and removal of file material, the provision of:

multi-positionable file guide means each including a thin planar strip element having at least three spaced holes along its longitudinal axis and having a tab for bearing indexing data extending laterally from each longitudinally edge portion, from between adjacent spaced holes, and in longitudinal offset relation, whereby said strip element may be turned about its longitudinal axis to locate a tab in one of two observeable upward positions each of said tabs having oppositely directed tab faces, one of said tab faces being observeable in one of two said upward positions.

3. A one-piece file index guide means comprising:

a planar elongate strip element having parallel longitudinal edges, oppositely directed surfaces of generally uniform width, and a longitudinal central axis having spaced holes therealong adapted to receive support elements;

a tab extending from each of said longitudinal edges and in longitudinal spaced relation, each tab having oppositely directed faces co-planar with said surfaces, each tab face providing an area for selected indexing data, whereby selected data on each tab face is positionable in one observeable position and upon rotating said strip element about its longitudinal and/or lateral axis in other non-observeable positions, each of said positions varying with respect to the longitudinal and lateral axes of the strip, each tab face being observeable in a different position by such multipositioning of said strip element relative to its longitudinal and lateral axes.

* * * * *